US008273193B2

(12) United States Patent
Xu et al.

(10) Patent No.: US 8,273,193 B2
(45) Date of Patent: Sep. 25, 2012

(54) LEAD-FREE, BISMUTH-FREE FREE-CUTTING SILICON BRASS ALLOY

(75) Inventors: Chankai Xu, Xiamen (CN); Zhenqing Hu, Xiamen (CN); Siqi Zhang, Changsha (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 12/651,723

(22) Filed: Jan. 4, 2010

(65) Prior Publication Data

US 2011/0104000 A1 May 5, 2011

Related U.S. Application Data

(63) Continuation-in-part of application No. 12/407,720, filed on Mar. 19, 2009, now abandoned.

(30) Foreign Application Priority Data

Dec. 2, 2008 (CN) ..... 2008 1 0180201

(51) Int. Cl.
*C22C 9/02* (2006.01)

(52) U.S. Cl. ..... 148/433; 148/434; 420/476; 420/477; 420/478; 420/479; 420/484

(58) Field of Classification Search ..... 148/433, 148/434; 420/476, 477, 478, 479, 484
See application file for complete search history.

(56) References Cited

U.S. PATENT DOCUMENTS

| | | | | |
|---|---|---|---|---|
| 5,137,685 | A * | 8/1992 | McDevitt et al. | 420/477 |
| 5,487,867 | A * | 1/1996 | Singh | 420/471 |
| 2004/0159375 | A1 | 8/2004 | Yamagishi | |
| 2007/0062615 | A1 | 3/2007 | Oishi | |

FOREIGN PATENT DOCUMENTS

| | | | |
|---|---|---|---|
| CN | 1693502 | * | 11/2005 |
| EP | 1559802 | A1 | 8/2005 |
| JP | 2002038246 | * | 2/2002 |

OTHER PUBLICATIONS

European Search Report for European Application No. 09174544.8, dated Feb. 11, 2010.

* cited by examiner

*Primary Examiner* — Sikyin Ip
(74) *Attorney, Agent, or Firm* — McDermott Will & Emery LLP

(57) ABSTRACT

The present invention supplies a lead-free, bismuth-free free-cutting silicon brass alloy with high zinc which preferably comprises 35.0 to 42.0 wt % Zn, 0.1 to 1.5 wt % Si, 0.03 to 0.3 wt % Al, 0.01 to 0.36 wt % P, 0.01 to 0.1 wt % Ti, 0.001 to 0.05 wt % rare earth metals selected from the group consisting of La and Ce, 0.05 to 0.5 wt % Sn, and/or 0.05 to 0.2 wt % Ni, and the balance being Cu and unavoidable impurities. In yet another embodiment, the alloy may be boron-free. The invented alloy is excellent in castability, weldability, cuttability, electroplating properties, corrosion resistance, mechanical properties. The alloy is especially applicable in castings which need cutting and welding under low pressure die casting, such as castings for faucet bodies in the water supply system. The alloy is also suitable for use in components which are produced from casting ingots by die forging.

7 Claims, 6 Drawing Sheets

LEAD-FREE, BISMUTH-FREE FREE-CUTTING SILICON BRASS ALLOY

CROSS REFERENCE TO RELATED APPLICATIONS

This is a continuation-in-part of U.S. patent application Ser. No. 12/407,720, filed on Mar. 19, 2009, now abandoned, which claims priority from Chinese application 200810180201.9, filed on Dec. 2, 2008.

FEDERALLY SPONSORED RESEARCH OR DEVELOPMENT

Not applicable.

FIELD OF THE INVENTION

The present invention generally relates to a lead-free, bismuth-free free-cutting silicon brass alloy, in particular a lead-free, bismuth-free free-cutting silicon brass alloy with high zinc which is applicable in low pressure die castings and forgings. In another embodiment, the alloy may also be boron-free.

BACKGROUND OF THE INVENTION

Currently, several series of casting brass alloys are in widespread use, for example, the Cu—Zn series, Cu—Zn—Si series, Cu—Zn—Al series. Each series includes lead-containing alloys. Lead-containing casting brass alloys have excellent cuttability, castability and low cost. However, these alloys harm the environment and the human body in the process of their production and usage. Furthermore, lead-containing brass alloys have poor weldability.

The harmfulness of lead to the environment and the human body is of great concern. Over the past 15 years, many patents for lead-free or low lead free-cutting brass alloys have been published or granted in the US, China, Japan, Germany and Korea. There are twenty bismuth brass alloys (CN2005100504254, CN2003101091620, CN021219915, CN941926133, CN931200644, CN2007100674803, CN2005800014925, CN2008100659066, U.S. Pat. Nos. 6,599,378, 5,653,827, 5,288,458, 5,409,552, 5,630,984, 5,614,038, US 2004/0159375, JP2000239765, JP2002003967, JP2001059123, JP2006322059, JP2003119527), ten silicon brass alloys (CN2004100891500, CN2004100042937, CN2005800194114, CN2005800464607, US20070169854, US 20020069942, US 20070062615, US 20050247381, JP2000336441, JP2001064742), seven tin brass alloys (CN2004100042922, CN031551777, CN2006100056892, US 2004241038, US20040159375, JP2000087158, JP2003147460, two antimony brass alloys (CN2007100708034, CN2004100158365), one magnesium brass alloy (CN2007100359122), one aluminum brass alloy (U.S. Pat. No. 3,773,504) and one tellurium brass alloy (CN2004100222446) disclosed in the prior art. These references primarily disclose lead-free free-cutting deformation brass alloys. Few, if any, references disclose lead-free alloys that are applicable in castings and/or low pressure die casting.

Published lead-free or low lead free-cutting casting bismuth brass alloys include UNS C89550 (high zinc, lead-free), UNS C89837 (low zinc, high copper, lead-free), UNS C89510 and UNS C89520 (low zinc, high copper, lead-free), and FR CuZn39Bi1Al. These alloys contain small amount of Sn and Se. The bismuth brass alloys disclosed by some references add expensive Se and Sn and even more expensive Te and In to change the dispersion of Bi in the grain boundary from continuous film to discontinuous particle. This has the beneficial effect of decreasing the hot and cold brittleness of the bismuth brass alloy.

One disadvantage of prior art bismuth-brass alloys is that the metals Bi, Sn, Ni, Se, Te and In are relatively expensive. Another disadvantage of prior art bismuth brass alloys is that they have poor castability and weldability. Accordingly, castings made of bismuth brass alloys by low pressure die casting are prone to cracking, resulting in a low overall yield. Also, castings made of bismuth brass alloys by brazing are also prone to cracking in weld and heat-affected zones. Furthermore, the forging temperature range is narrow. These are some of the obstacles presented by bismuth brass alloys. There is a need for mass-produced faucet bodies and valve bodies made from lead-free free-cutting brass, by low pressure die casting and weld-forming and by forging and weld-forming, respectively. Since bismuth is relatively rare and expensive, and requires improvements in technological properties such as castability and weldability beyond what is currently known in the art, the application and development potential of bismuth brass alloy is limited.

Current casting silicon brass alloys usually contain Pb. These alloys are highly prone to be hot cracked in the process of low pressure die casting. Furthermore, the Pb release will exceed the requirement of NSF61 standard.

Nowadays, research and development of lead-free or low lead free-cutting silicon brass alloys is typically based on brass alloys with low zinc and high copper. These alloys rely on increasing the relative ratio of hard and brittle γ phase in the alloy to ensure the free-cuttability of the alloy. This approach sacrifices the plasticity of the alloy and is detrimental to casting formings and process formings. Furthermore, as the content of Cu is high, the cost of materials is high. At present, many prior art silicon brass alloys are deformation alloys. The content of zinc and copper in these alloys overlap, and most are silicon brass alloys with high copper. Typically, there is little discussion or disclosure of the castability of the alloys, or their suitability for low pressure die casting.

For example, two antimony brass alloys prior arts (CN2007100708034 and CN2004100158365) issued to Zhang et al. both disclosed Sb as one of the main elements of the alloys. But Zhang et al. do not discuss or disclose the castability of the alloy, particularly the castability applied on low pressure die casting. Furthermore, the Sb release of these alloys into the water may exceed the NSF/ANSI61-2007 standard and should not be used for drinking water supply system applications.

The internal construction of faucet bodies is very complex. The faucet bodies typically are hollow castings with slim walls whose thickness can vary. The cooling intensity of the mold for low pressure die casting is large. The alloy must have excellent castability, especially excellent mold filling performance and hot crack resistance. These kinds of castings also are subjected to cutting processes including, for example, sawing, lathing, milling, drilling and polishing. All these processes require the alloy to have excellent cuttability. There is a need for mass-produced faucets made by casting and weld molding, and for valves made by forging and weld molding. These applications require the alloys to have excellent weldability. Additionally, standards for drinking water, such as NSF/ANSI61-2007 strictly restrict the amount of elements such as Sb, Pb, Cd, and As that can be released into the water. For example, under the NSF/ANSI61-2007 standard, the maximum acceptable release amount of Sb and Pb is 0.6 ug/L and 1.5 ug/L, respectively. If the Sb content in the brass alloy exceeds 0.2 wt %, the amount of Sb release into the water will exceed 0.6 ug/L. Thus, some antimony brass alloys are not suitable for use in drinking water system installations.

DETAILED DESCRIPTION

One object of the present invention is to provide a free-cutting silicon brass alloy with high zinc which is excellent in castability, forging performance, cuttability, weldability, mechanical properties, corrosion resistance and electroplatability and whose cost is rather lower, especially a free-cutting and weldable silicon brass alloy with high zinc which is applicable in low pressure die casting and forging. This alloy will solve the limitations of conventional brass alloys discussed above especially the problem of lead contamination.

The object of the present invention is achieved by the novel selection and composition of elements comprising the alloy.

The basic theory behind the composition of the present alloys is to use the mutual interaction of multiple alloy elements in low amounts to form different multi-element intermetallic compound grains, which improve the cuttability of the alloys and ensure excellent castability, weldability, cuttability and corrosion resistance.

The present invention comprises: 35.0 to 42.0 wt % Zn, 0.1 to 1.5 wt % Si, 0.03 to 0.3 wt % Al, 0.01 to 0.36 wt % P, 0.01 to 0.1 wt % Ti, 0.001 to 0.05 wt % rare earth metals, 0.05 to 0.5 wt % Sn and/or 0.05 to 0.2 wt % Ni and the balance being Cu and unavoidable impurities.

In yet another embodiment, the amount of zinc comprises 39.00 to 42.00 wt % Zn. In a still further embodiment, the amount of Zn comprises 40.00 to 42.00 wt % Zn.

In another embodiment, the amount of silicon comprises 0.1 to 0.5 wt % Si. In yet another embodiment, the amount of Si comprises 0.2 to 0.5 wt % Si. In a still further embodiment, the amount of Si comprises 0.1 to 0.2 wt % Si.

In another embodiment, the amount of phosphorus comprises 0.01-0.30 wt % P. In yet another embodiment, the amount of phosphorus comprises 0.1-0.3 wt % P. In a still further embodiment, the amount of phosphorus comprises 0.01-0.1 wt % P. In yet another embodiment, the amount of phosphorus comprises 0.15-0.30 wt % P. And in another embodiment, the amount of phosphorus comprises 0.15-0.25 wt % P.

Another embodiment may include titanium in the amount of 0.05-0.1% Ti.

A still further embodiment may include rare earth elements in the amount of either 0.001-0.04 wt % rare earth elements, or 0.001-0.01 wt % rare earth elements.

Yet another embodiment may include tin in the amount of either 0.05-0.2 wt % Sn, or 0.05-0.1 wt % Sn, or 0.1-0.3 wt % Sn.

Still further embodiments may include nickel in the amount of either 0.05-0.15 wt % Ni, or 0.05-0.1% wt % Ni.

If present, antimony (Sb) is present in the alloy as an unavoidable impurity, and in any even will not be present in amounts in excess of 0.04 wt % Sb.

Magnesium is an optional element in the inventive alloy. If included in the alloy, the magnesium is present in an amount of 0.05-0.4 wt % Mg, or 0.05-0.3 wt % Mg, or 0.1-0.25 wt % Mg.

The elongation rate of the casting alloy is more than 10%. The hardness is in the range of HRB (Rockwell hardness scale B) 55 to 75. The folding angle of the strip samples is larger than 55°.

In the present alloys, Si is a main element along with Zn. The alloys also contain Al, Mg, Sn and P. The effects of using Si include, for example, deoxidization for improving castability, weldability, corrosion resistance, particularly improving dezincification corrosion resistance, increasing relative ratio of β phase and forming small amount of γ phase and improving cuttability of the alloys. The present invention demonstrates that Si has the effect of refining α phase grain, which is beneficial for improving the intensity, elongation rate and cracking resistance of the alloys. Grain refining is beneficial for mechanical properties and cuttability because the intermetallic compounds are further dispersed in the grain boundary, phase boundary and grain interior. For castings with relatively complex constructions and thick cross-sections, applicable in low pressure die casting. When the content of Si is within the maximum, no hard and brittle γ phase appears and the alloy is in β phase zone at high temperature and in (α+β') phrase zone at temperature lower 450° C. β' phase is the intermetallic compound with disordered body-centered crystal structure. The plasticity of β phase at high temperatures is better than α phase, so it is beneficial for hot cracking resistance of the alloy. β' phase is the intermetallic compound with ordered, body-centered crystal structure. β phase is harder and more brittle than β phase so it is beneficial for cuttability. However, when the alloy is in β' phase zone at room temperature, the brittleness of the alloy will increase such that it is prone to cold cracking, and the hardness will be greater than HRB 80. This is bad for cuttability.

The total zinc equivalents of Zn, Al and Si must be lower than 45 wt %. For example, if the content of Zn in the alloy is 40 wt %, and Al is 0.2 wt %, the content of Si typically can't exceed approximately 0.37%. This is because the zinc equivalent of aluminum is six (6), and the zinc equivalent of silicon is ten (10). Accordingly, for the composition discussed immediately above, the zinc equivalent of the zinc would be 40% (its actual percentage level in the alloy), the zinc equivalent of the aluminum would be 1.2% (0.2 wt % aluminum×6), and the zinc equivalent of the silicon would be 3.7% (0.37 wt % silicon×10), for a total zinc equivalent of 44.9%, which is lower than 45 wt % zinc equivalent. As the radial heat dissipation of the continuous casting ingots for die forging is uniform, and the axial solidification is in order, the alloy is not prone to be hot cracked. Therefore, the content of Si is preferably in the range of 0.6 to 1.5 wt %. For products whose construction by low pressure die casting is relatively simple, the content of Si is preferably in the range of 0.4 to 1.3 wt % so that small amount of γ phase will be formed in the alloy for improving the cuttability.

The effects of adding Al include solid solution strengthening, corrosion resistance improvement, hot cracking resistance improvement and deoxidization. The content of Al is preferably in the range of 0.03 to 0.3 wt %. If the content of Al is lower than 0.03 wt %, its beneficial effects are not apparent. If the content of Al is higher than 0.3 wt %, Al is prone to oxidizing and slag formation such that the fluidity of the alloy will be decreased. Castability and weldability are accordingly decreased. Moreover, Al will make the silicon brass alloy grain coarser and decrease the condensability of the castings and ingots.

P is included in the inventive alloy. The solid solubility of Pin the matrix of copper will be reduced rapidly with the temperature decreasing. The solid solubility will be equivalent to zero when the temperature is equivalent to the room temperature, precipitated P with Cu will form brittle intermetallic compound $Cu_3P$. In the cutting process, this intermetallic compound is prone to cracking so that the cutting chips are prone to breaking, which ensures the alloy excellent cuttability. Prior art brass alloys may add 0.003 to 0.006 wt % P for deoxidization. When the content of P exceeds 0.05 wt %, the intermetallic compound $Cu_3P$ will be formed. In the present alloys, the content of P is in the range of 0.01 to 0.4 wt %. This range of P improves deoxidization, which improves the castability and weldability of the alloy and decreases the oxidization loss of other useful elements. And the formed $Cu_3P$ further improves the cuttability of the alloys. Thus, in the present invention, P is beneficial for cuttability, castability and weldability. Relatively small amounts of P also have the effect of grain refining.

The effect of Mg in the brass alloy is similar to the effect of P, that is, deoxidization and grain refining. The intermetallic compound $Cu_2Mg$ which is formed by Mg and Cu is also beneficial for improving the cuttability of the alloy. However, $Cu_2Mg$ is not hard and brittle like $Cu_3P$ but it is somewhat bad for the plasticity of the alloys. Mg also will form $Mg_2Si$ with Si. It's found by SEM (scanning electron microscope) observation that Mg—Si particles are uniformly dispersed granularly in the interior of α phase grain, grain boundary and phase boundary. Mg—Si particles are not found in the interior of β phase grain. Mg together with elements Sb, Cu and Zn also forms a complex intermetallic compound which is granularly dispersed in the interior of grains. These multi-element intermetallic compound particles are not only beneficial for improving the cuttability of the alloys, but also beneficial for decreasing the loss of Mg during casting. The content of Mg will be in the range of 0.05 to 0.4 wt %, if any in the inventive alloys. This amount of Mg is sufficient for deoxidization, grain refining and improving the castability of the alloys. If the content of Mg is in the middle to upper limits of the specified range, it is also beneficial for the cuttability. Mg is better than P at improving the castability of the alloys. Mg improves the hot cracking resistance of the alloy and effectively eliminates the cracking of the castings.

Rare earth metals are a group of elements including La and Ce. Ti and rare earth metals are effective grain refiners and also have the effect of deoxidization. Rare earth metals also have the effect of purifying the grain boundary. Rare earth metals will form high melting point intermetallic compounds with low melting point impurities in the grain boundary and therefore decrease the hot brittleness of the alloys or form intermetallic compounds with other harmful impurities in the grain boundary and therefore decrease the harmfulness of harmful impurities. Rare earth metals also could mutually interact with most alloying elements and form more stable intermetallic compounds. Therefore, rare earth metals and Ti are typically added to lead-free free-cutting brass alloys. However, rare earth metals are prone to oxidizing. Even if only a small quantity is added, the flowability of the alloys will decrease. The inventive alloys selectively add 0.001 to 0.05 wt % rare earth metals. This amount of rare earth metals will improve the mechanical performance, but is bad for the castability, as embodied in volume shrinkage samples wherein the face of the concentrating shrinkage cavity is not smooth and small visible shrinkage porosity in the bottom of the concentrating shrinkage appears.

The selective addition of Ni is for solid solution strengthening, corrosion resistance improvement and especially the stress corrosion resistance improvement of the alloys. However, when Al is also added to the alloys, Ni together with Al will form hard and brittle intermetallic compounds with high melting points. This will decrease the alloy's plasticity. The selective addition of Sn improves the corrosion resistance of the alloys, especially the dezincification corrosion resistance of the alloys. Sn also can form intermetallic compounds with Sb. With increased addition of Sn, Sb release amount into the water will decrease. When the content of Sb exceeds 0.2 wt %, however, even if the content of Sn increases, the Sb release amount into the water will exceed the NSF/ANSI61-2007 standard as well as result in grain coarsening. The cracking resistance, intensity and elongation rate will decrease. The effect that Sn decreases Sb release amount into the water is very limited. Since Ni and Sn are very expensive, their levels are better kept around lower limit.

Fe is a common impurity in copper and copper alloys. It has the effect of refining a phase grain in copper and brass. The solid solution of Fe at room temperature is very low. Fe without solid solution or Fe precipitated from solid solution will decrease the plasticity and corrosion resistance of the alloys and form hard and brittle hard spots with Al, Si and B. The hard spots may be located in the face of castings and forgings and then influence the facial quality of the electroplated products. The facial glossiness of products is affected by these spot discrepancies. Therefore, the content of Fe should be equal or lower than 0.1 wt %.

The content of Pb should be equal or lower than 0.1 wt %. This level is beneficial for cuttability improvement and the release amount into the water will not exceed the standard NSF/ANSI61-2007. (1.5 ug/L)

Sb as an unavoidable impurity should be equal or lower than 0.04 wt %. At this level, the Sb release amount into the water will not exceed the standard NSF/ANSI61-2007(0.6 ug/L).

For obtaining both castability and cuttability of the alloys, the alloy composition should meet the following requirements: the elongation rate of As-Cast alloy should be larger than 5%, the hardness is in the range of HRB 55 to 75, and the bending angle of strip samples is preferably larger than 55°.

The advantages of the invented alloy include, but are not limited to: excellent castability and weldability, satisfactory performance in processes such as casting, forging, welding, sawing, lathing, milling, drilling, polishing and electroplating, and desirable properties for faucet bodies including stress corrosion and salt spray corrosion resistance, dezincification corrosion resistance, low Pb release amounts, low Sb release amounts, low water leakage, and improved mechanical performance and hardness. The inventive alloys have excellent forging performance and the range of forging temperature is large. Ingots rather than extruded bars could be disposably die forged to components with complex structure. This is beneficial for recycling and re-use of Pb brass alloy, phosphorus brass alloys, magnesium brass alloys, antimony brass alloys, silicon brass alloys and common brass alloys. Furthermore, metal materials cost and total production costs are lower.

The steps of manufacturing of the invented alloy are as follows: Material proportioning—melting in the intermediate frequency induction electric furnace(with flux for refining)—pouring to be ingots—remelting—low pressure die casting to be castings or horizontal continuous casting to be rod—flaying—forging. The temperature for low pressure die casting is in the range of 970° C. to 1000° C. The temperature for horizontal continuous casting is in the range of 990° C. to 1030° C. The temperature for forging is in the range of 600° C. to 720° C.

The advantages of the present manufacturing method include strong operability. In other words, the present universal production equipments and tool and die and even low pressure die casting mold and sand core for brass continuous casting, low pressure die casting and forging may be used without a redesign or revision.

BRIEF DESCRIPTION OF THE DRAWINGS

To understand the present invention, it will now be described by way of example, with reference to the accompanying drawings in which.

EXAMPLES

Figure 1:
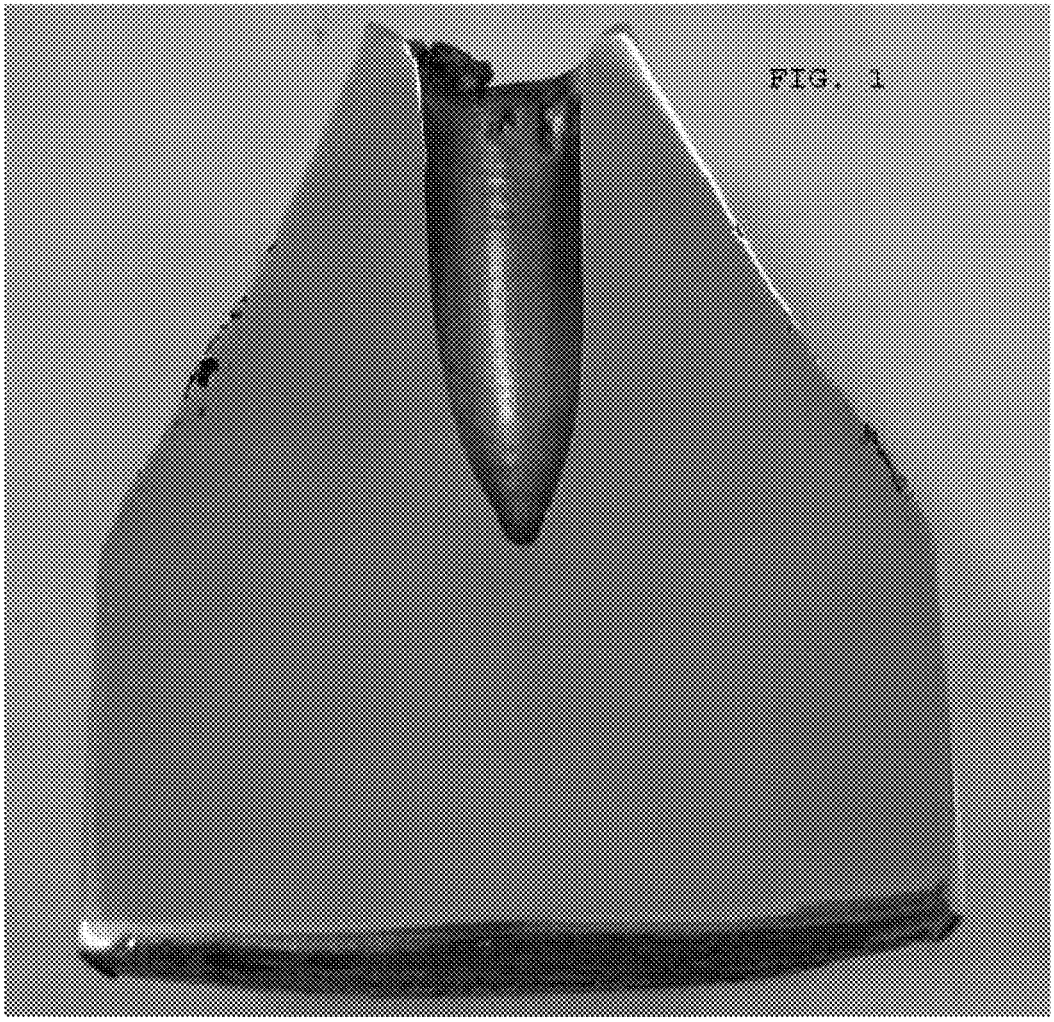
FIG. 1 shows the characteristics of volume contraction samples formed in Example 1 of Table 1.
Figure 2:
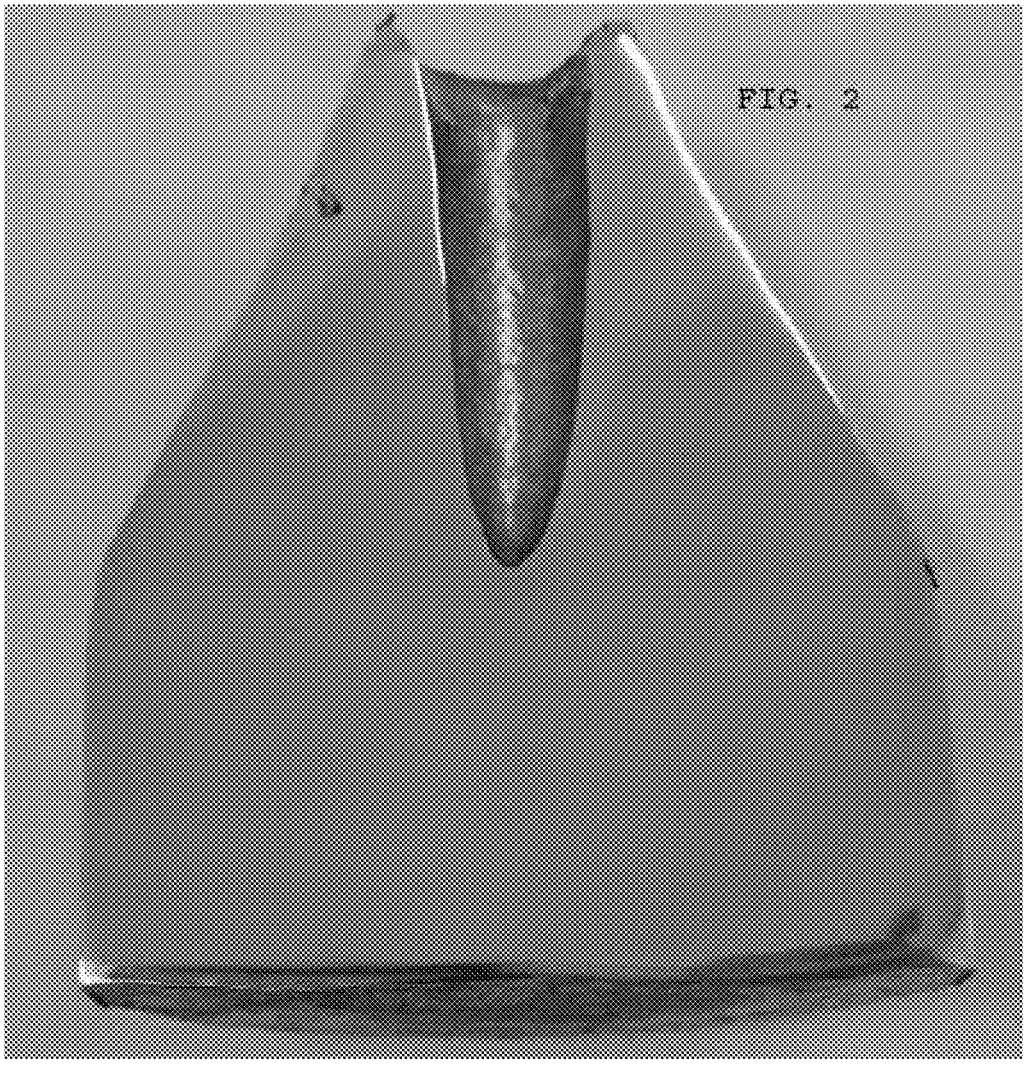
FIG. 2 shows the characteristics of volume contraction samples formed in Example 14 of Table 1.
Figure 3:
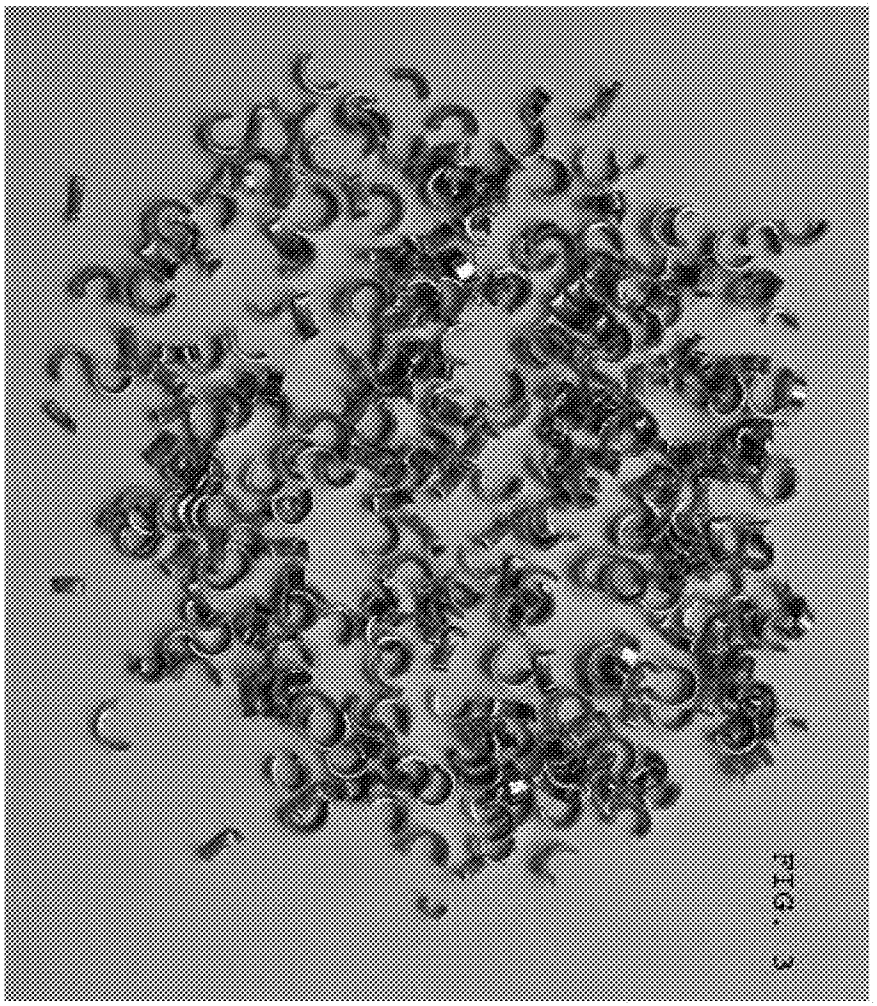
FIG. 3 shows the shapes of the cutting chips formed in Example 1 of Table 1.
Figure 4:
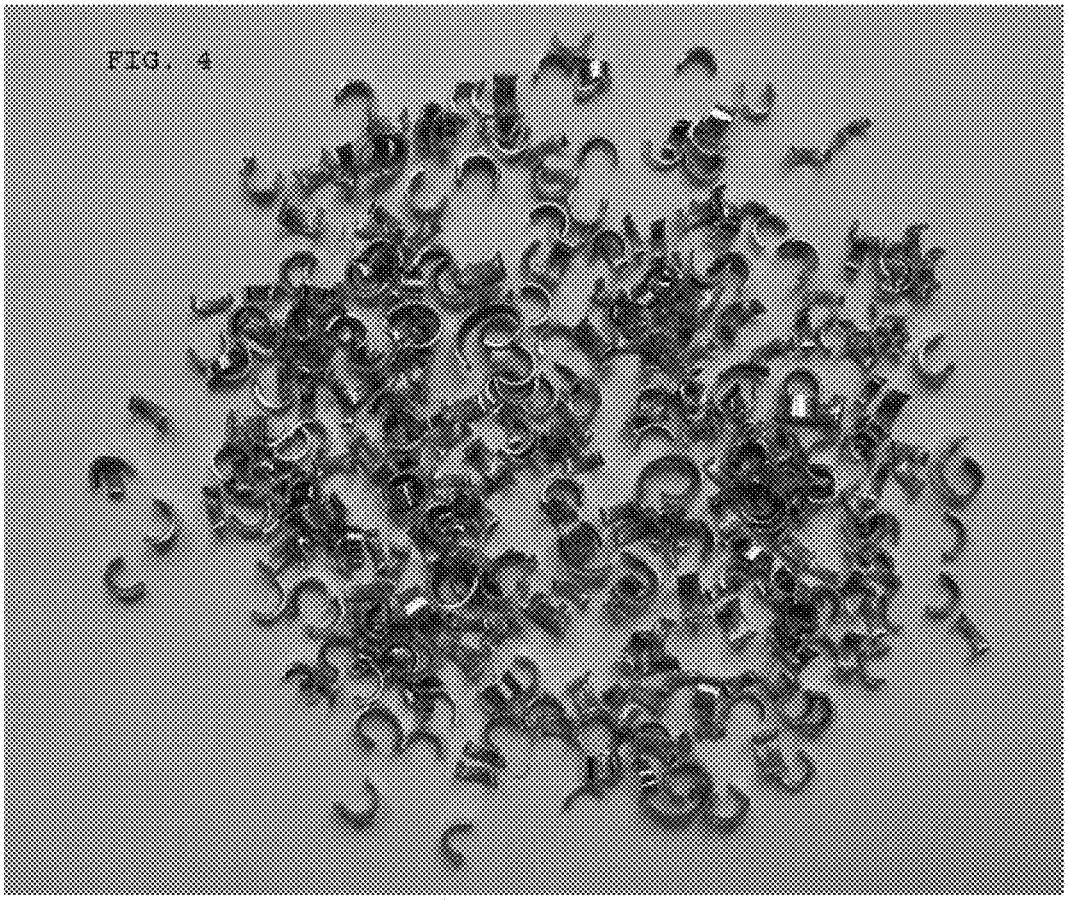
FIG. 4 shows the shapes of the cutting chips formed in Example 6 of Table 1.
Figure 5:
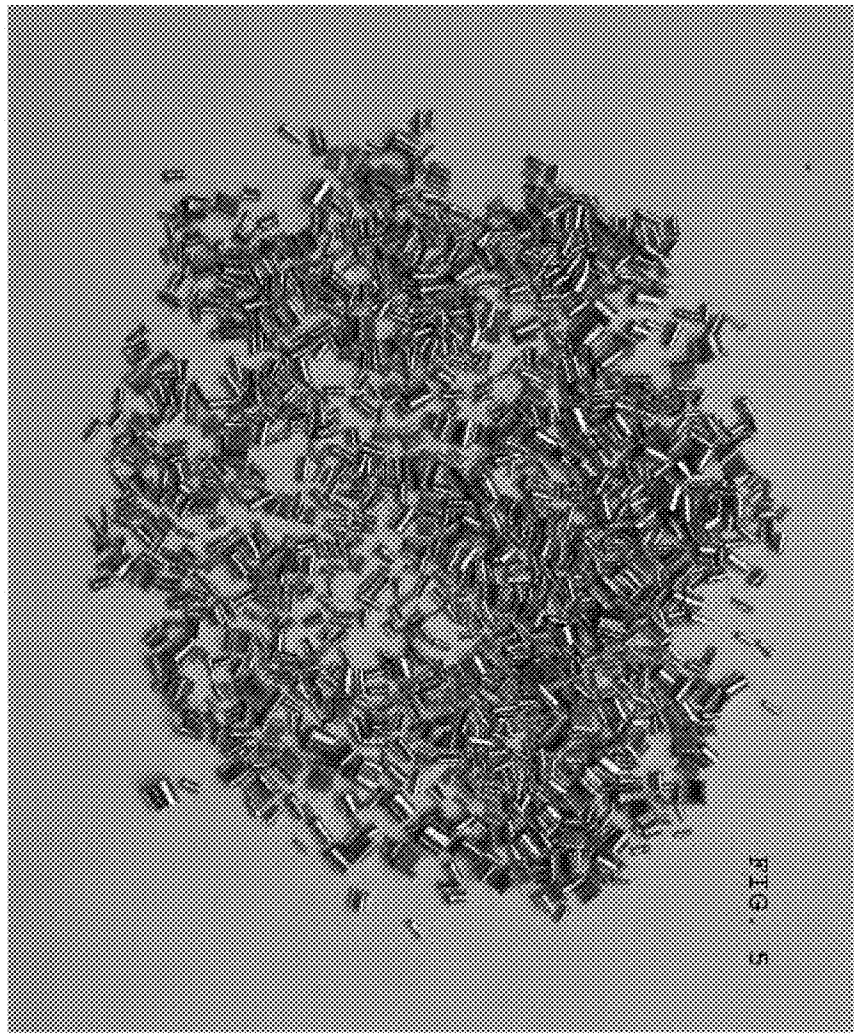
FIG. 5 shows the shapes of the cutting chips formed in Example 14 of Table 1.
Figure 6:
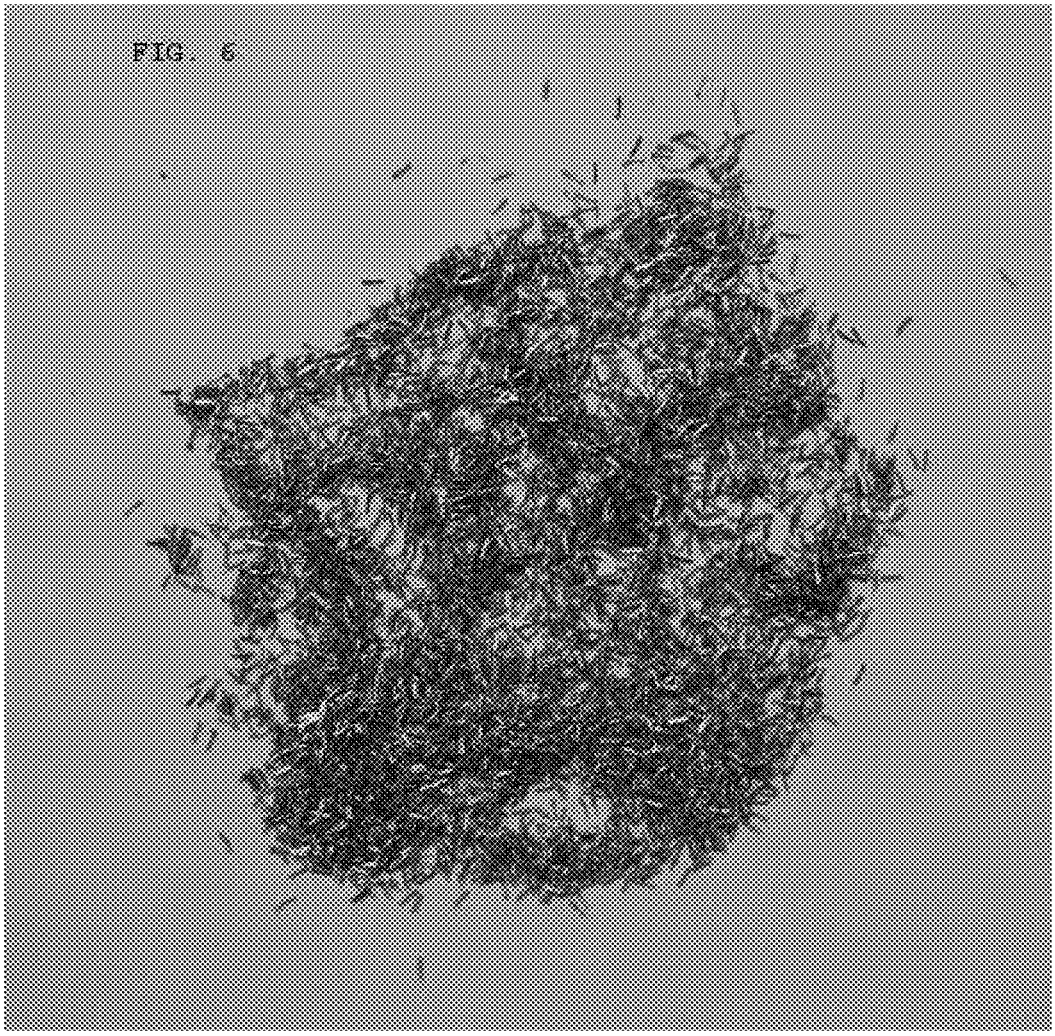
FIG. 6 shows the shapes of the cutting chips formed in cutting lead-contained brass alloy C36000 for comparison.

Examples of alloys according to the present invention are shown in Table 1. The raw materials used in the alloys include: No. 1 Cu, No. 1 Zn, A00 Al, No. 1 Ni, No. 1 Sn, Cu—Si master alloy, Cu—P master alloy, Cu—Ti master alloy, misch metal, magnesium alloys, old materials of No. 1 Pb ingots or C36000, the covering agent, and flux as the refining agent.

One method of manufacturing the alloys is as follows. First, No. 1 Cu, Cu—Si master alloys, No. 1 Ni, and the covering agent that enhances slag removal efficiency are added to the furnace. These materials are heated until they have melted to form a melt mixture and are thereafter stirred. Then the No. 1 Zn is added to the melt mixture, melt and be stirred. Slag is skimmed from the melt and is covered. Then flame throw is processed. Thereafter, Cu—P master alloys and Magnesium alloys are added and the mixture is stirred. The left metal materials are added. These materials are again heated until melted, and are thereafter stirred. The flux for refining is added and the mixture stands until the ingots are formed. Then the low pressure die casting occurs at the temperature in the range of 970 to 1000° C. or horizontal continuous casting occurs at the temperature in the range of 990° C. to 1030° C. after the ingots are remelted. Finally, the hot forging is processed at the temperature in the range of 600 to 720° C.

Examples 1, 6 and 14 were used to make 3 different types of faucet bodies by low pressure die casting and weld-forming. The formability was acceptable.

The temperature for low pressure die casting of the example alloy is in the range of 970 to 1000° C. The pouring temperature for testing castability is 1000° C. The lead-free, bismuth-free brass alloy of present invention has been tested with results as follows:

Castability Test

Four kinds of standard casting alloy samples were used to measure the castability of the alloy. The volume shrinkage samples are for evaluating the characteristics of concentrating shrinkage, dispersed shrinkage and porosity. Spiral samples are for measuring the flow length of the alloy melt. Strip samples are for measuring linear shrinkage rate and bend angle of the alloy. The cylindrical samples with different wall thickness are for measuring shrinkage crack resistance of the alloy. For volume shrinkage samples, as may be seen in Table 2, if the face of the concentrating shrinkage cavity is smooth, there is no visible shrinkage porosity in the bottom of the concentrating shrinkage cavity, and there is no visible dispersed shrinkage cavity in the section of the samples, then this indicates castability is excellent and is shown as "○" in Table 2.

If the face of the concentrating shrinkage cavity is smooth but the height of visible shrinkage porosity in the bottom of the concentrating shrinkage cavity is less than 5 mm, and there is no visible dispersed shrinkage cavity in the section of the samples, this indicates castability is good, and is shown as "□" in Table 2.

If the face of the concentrating shrinkage cavity is not smooth and the height of visible shrinkage porosity in the bottom of the concentrating shrinkage cavity is more than 5 mm, whether or not there is dispersed shrinkage cavity in the section of the samples, this indicates castability is poor, and is shown as "x" in Table 2.

For cylindrical samples, as may be seen in Table 2, if no visible crack is shown on the casting or polished surface, this indicates castability is excellent and will be shown as "○" in Table 2. If the visible crack is shown, this indicates the castability is poor, and will be shown as "x" in Table 2.

TABLE 1

Composition of example alloys (wt %)

| Example | Cu | Si | Al | P | Sn | Ni | Mg | Ti | rare earth | Pb + Fe | Zn |
|---|---|---|---|---|---|---|---|---|---|---|---|
| 1 | 59.79 | 0.34 | 0.20 | 0.10 | 0.09 | 0.104 | — | — | 0.003 | <0.2 | Balance |
| 2 | 60.15 | 0.34 | 0.18 | 0.16 | 0.09 | 0.106 | 0.25 | — | — | <0.2 | Balance |
| 3 | 60.20 | 0.38 | 0.24 | 0.12 | 0.15 | 0.11 | — | — | 0.004 | <0.2 | Balance |
| 4 | 59.83 | 0.36 | 0.26 | 0.15 | 0.08 | — | 0.10 | — | 0.001 | <0.2 | Balance |
| 5 | 59.61 | 0.39 | 0.27 | 0.14 | 0.14 | — | — | 0.05 | — | <0.2 | Balance |
| 6 | 61.11 | 0.12 | 0.06 | 0.28 | 0.12 | 0.11 | 0.12 | — | 0.002 | <0.2 | Balance |
| 7 | 59.86 | 0.14 | 0.23 | 0.31 | 0.15 | — | — | — | 0.005 | <0.2 | Balance |
| 8 | 59.34 | 0.15 | 0.25 | 0.29 | 0.18 | — | — | 0.013 | — | <0.2 | Balance |
| 9 | 60.20 | 0.12 | 0.09 | 0.27 | — | — | 0.10 | — | — | <0.2 | Balance |
| 10 | 60.37 | 0.15 | 0.31 | 0.30 | — | 0.13 | — | 0.03 | — | <0.2 | Balance |
| 11 | 60.55 | 0.20 | 0.34 | 0.30 | — | — | 0.13 | — | 0.002 | <0.2 | Balance |
| 12 | 61.04 | 0.18 | 0.25 | 0.06 | — | — | 0.28 | — | — | <0.2 | Balance |
| 13 | 60.69 | 0.21 | 0.28 | 0.05 | 0.11 | — | 0.30 | — | — | <0.2 | Balance |
| 14 | 60.31 | 0.25 | 0.24 | 0.08 | 0.09 | 0.14 | 0.35 | — | — | <0.2 | Balance |

TABLE 2

Castability of the invented alloy examples

| | | Examples | | | | | | | | | | | | | | |
|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | C36000 |
| Concentrating shrinkage | | ○ | ○ | ○ | ○ | ○ | ○ | ○ | ○ | ○ | ○ | ○ | ○ | ○ | Δ | ○ |
| Flowing Length/mm | | | 410~470 | | | | | | 410~460 | | | | | 400~430 | | 400 |
| Linear shrinkage rate/% | | | | | | | | 1.4~1.7 | | | | | | | | 2.1 |
| Bend angles/° | | >90 | 50 | 75 | 75 | 60 | 80 | 70 | | 60~65 | | | | 50~55 | | |
| Wall sickness | 2.0 mm | ○ | ○ | ○ | ○ | ○ | ○ | ○ | ○ | ○ | ○ | x | ○ | ○ | x | ○ |
| | 3.5 mm | ○ | ○ | ○ | ○ | ○ | ○ | ○ | ○ | ○ | ○ | ○ | ○ | ○ | ○ | ○ |
| | 4.0 mm | ○ | ○ | ○ | ○ | ○ | ○ | ○ | ○ | ○ | ○ | ○ | ○ | ○ | ○ | ○ |
| HRB | | 60 | 76 | 70 | 63~70 | | 69 | | | 62~71 | | | | 65~73 | | 44 |

Cuttability:

Many measures can be used to evaluate cuttability. One way is to determine the relative cutting ratio of the invented alloy by measuring the cutting resistance and assuming the relative cutting ratio of the lead-contained brass alloy such as C36000 is 100%. The relative cutting ratio of the present example is shown as follows:

$$\text{Relative cutting ratio} = \frac{\text{Cutting resistance of alloy } C36000}{\text{Cutting resistance of the invented alloy}} \times 100\%$$

The samples for testing cuttability are selected from the sprue portions of the castings made for tensile testing. The feeding quantity is 0.5 mm. Other cutting parameters are the same. The results are shown in Table 3.

Mechanical properties

The mechanical properties test results are shown in Table 3.

Corrosion resistance:

The samples for testing corrosion resistance are As-Cast. The samples of Examples 1, 6 and 14 are from faucet bodies formed by low pressure die casting. The samples of other Examples are ring samples which are typically for measuring the castability, as they cannot free shrink in the process of solidification and cooling and their internal stress is relatively large. The samples for testing salt spray corrosion and stress corrosion resistance are electroplating products. The stress corrosion resistance test was conducted according to GSO481.1.013-2005 standard (Ammonia fumigation). The salt spray corrosion resistance test was conducted according to ASTMB368-97(R2003)E1 standard. The dezincfication corrosion resistance test was conducted according to GB10119-1988 standard. The test of metal release amount was conducted according to NSF/ANSI61-2007 standard. The test results are shown in Table 4.

TABLE 3

Mechanical properties and relative cutting ratio of the invented alloy examples

| | | Examples | | | | | | | | | | | |
|---|---|---|---|---|---|---|---|---|---|---|---|---|---|
| | | 1 | 2 | 3 4 | 5 | 6 | 7 8 | 9 10 11 | 12 | 13 14 | C36000 | Remark |
| Tensile strength/MPa | Manual Casting | 400 | — | 450 | 460 | 370 | 420 | 410 | — | 430 | 340 | Tensile samples by manual casting and low pressure die casting is without machining; Tensile samples for horizontal continuous casting are ϕ10 mm samples machined from ϕ40 mm casting bars. |
| | Horizontal continuous casting | 430 | 450 | — | — | 410 | — | — | 440 | — | — | |
| | Low pressure die casting | 465 | — | — | — | 385 | — | — | — | — | — | |
| Elongation rate/% | Manual Casting | 13 | — | 9 | 10 | 12 | 8 | 6 | — | 8 | — | |
| | Horizontal continuous casting | 26 | 15 | — | — | 40 | — | — | 13 | — | — | |
| | Low pressure die casting | 8.5 | — | — | — | 9 | — | — | — | — | 37 | |
| Relative cutting ratio/% | | ≧80 | | — | | ≧80 | — | — | ≧85 | — | 100 | |

TABLE 4

Corrosion results of the invented alloy examples

| Examples | Stress corrosion resistance | Salt spray corrosion resistance | Average dezincification layer depth/mm Castings | Alloy ingots | Metal release amount Q Value/μg/L |
|---|---|---|---|---|---|
| 1 | Eligible | Eligible | 0.24 | 0.26 | Sb < 0.6 |
| 2 | Eligible | Eligible | | 0.28 | Pb < 1.5 |
| 3 | Eligible | Eligible | | 0.23~0.27 | As < 1.0 |
| 4 | Eligible | Eligible | | | Cd < 0.5 |
| 5 | Eligible | Eligible | | | Hg < 0.2 |
| 6 | Eligible | Eligible | 0.25 | 0.28 | Eligible |
| 7 | Eligible | Eligible | | 0.24~0.31 | |
| 8 | Eligible | Eligible | | | |
| 9 | Eligible | Eligible | | 0.26~0.33 | |
| 10 | Eligible | Eligible | | | |
| 11 | Eligible | Eligible | | | |
| 12 | Eligible | Eligible | 0.26 | 0.31~0.38 | |
| 13 | Eligible | Eligible | | | |
| 14 | Eligible | Eligible | | | |
| C36000 | Eligible | Eligible | | 0.40 | Pb > 0.5, Other eligible |

What is claimed is:

1. A lead-free, bismuth-free free-cutting silicon brass alloy consisting of: 35.0 to 42.0 wt % Zn, 0.1 to 1.5 wt % Si, 0.03 to 0.3 wt % Al, 0.01 to 0.36 wt % P, 0.01 to 0.1 wt % Ti, 0.001 to 0.05 wt % rare earth metals selected from the group consisting of La and Ce, 0.05 to 0.5 wt % Sn, optionally 0.05 to 0.2 wt % Ni, optionally Mg, and the balance being Cu and unavoidable impurities, wherein the total zinc equivalent of Zn, Al, and Si does not exceed 45 wt %, and wherein Sb is present as an unavoidable impurity, and where that Sb is present in the amount of less than 0.04 wt %, wherein an elongation rate of casting of the alloy is greater than 10%, hardness of the alloy is in a range of HRB 55 to 75, and a bending angle of strip samples of the alloy is more than 55°.

2. The lead-free, bismuth-free free-cutting silicon brass alloy of claim 1 consisting of 40.00 to 42.00 w t% Zn, 0.2 to 0.5 wt % Si, 0.01 to 0.1 wt % P, 0.1 to 0.3 wt % Sn, 0.05 to 0.15 wt % Ni, and 0.001 to 0.04 wt % rare earth metals selected from the group consisting of La and Ce, and further consisting of 0.1 to 0.25 wt % Mg.

3. The lead-free, bismuth-free free cutting silicon brass alloy of claim 1, wherein said alloy is also boron-free.

4. The lead-free, bismuth-free free-cutting silicon brass alloy of claim 1 consisting of 39.00 to 42.00 wt % Zn, and 0.1 to 0.3 wt % P.

5. The lead-free, bismuth-free free-cutting silicon brass alloy of claim 1, consisting of 39.00 to 42.00 wt % Zn, 0.1 to 0.2 wt % Si, 0.15 to 0.3 wt % P, 0.05 to 0.1 wt % Sn, 0.05 to 0.1 wt % Ni and 0.05 to 0.1 wt % Ti.

6. The lead-free, bismuth-free free-cutting silicon brass alloy of claim 1, consisting of 39.00 to 42.00 wt % Zn, 0.1 to 0.5 wt % Si, 0.15 to 0.25 wt % P, 0.05 to 0.2 wt % Sn, and 0.001 to 0.01 wt % rare earth metals selected from the group consisting of La and Ce, and further consisting of 0.05 to 0.4 wt % Mg.

7. The lead-free, bismuth-free free-cutting silicon brass alloy of claim 1, consisting of 40.00 to 42.00 wt % Zn, 0.1 to 0.2 wt % Si, 0.01 to 0.3 wt % P, 0.1 to 0.3 wt % Sn and 0.05 to 0.1 wt % Ni and further consisting of 0.05 to 0.3 wt % Mg.

* * * * *

UNITED STATES PATENT AND TRADEMARK OFFICE

CERTIFICATE OF CORRECTION

PATENT NO. : 8,273,193 B2
APPLICATION NO. : 12/651723
DATED : September 25, 2012
INVENTOR(S) : Xu et al.

It is certified that error appears in the above-identified patent and that said Letters Patent is hereby corrected as shown below:

On the title page, item (75), in the listing of inventors:

delete "Chankai" and replace with --Chuankai--

Signed and Sealed this
Thirteenth Day of November, 2012

David J. Kappos

David J. Kappos
*Director of the United States Patent and Trademark Office*